US008201306B2

(12) United States Patent
Kim

(10) Patent No.: US 8,201,306 B2
(45) Date of Patent: Jun. 19, 2012

(54) HINGE APPARATUS OF ENGINE HOOD FOR VEHICLE

(75) Inventor: Moon Kwan Kim, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 430 days.

(21) Appl. No.: 12/468,673

(22) Filed: May 19, 2009

(65) Prior Publication Data

US 2010/0107365 A1 May 6, 2010

(30) Foreign Application Priority Data

Oct. 30, 2008 (KR) ..... 10-2008-0107204

(51) Int. Cl.
*E05D 11/06* (2006.01)

(52) U.S. Cl. ..... 16/360; 16/357; 16/358; 16/361

(58) Field of Classification Search ..... 16/360, 16/357, 358, 361; 292/63, 76, 146.12, 136.06, 292/107.08; 180/69.21
See application file for complete search history.

(56) References Cited

U.S. PATENT DOCUMENTS

| | | | | |
|---|---|---|---|---|
| 2,639,462 | A * | 5/1953 | Fish | 16/302 |
| 3,135,011 | A * | 6/1964 | Fiedler | 16/288 |
| 4,712,828 | A * | 12/1987 | Albrecht | 296/121 |
| 5,050,270 | A * | 9/1991 | Burgei et al. | 16/298 |
| 7,596,833 | B2 * | 10/2009 | Erwin | 16/370 |
| 2005/0279550 | A1 * | 12/2005 | Saville et al. | 180/69.21 |

* cited by examiner

*Primary Examiner* — Victor Batson
*Assistant Examiner* — Matthew Sullivan
(74) *Attorney, Agent, or Firm* — Morgan, Lewis & Bockius LLP

(57) ABSTRACT

A hinge apparatus of an engine hood for a vehicle which is provided between a hood panel and a vehicle body panel to ensure rotation of the hood panel. The hinge apparatus includes a hinge bracket mounted to a vehicle body panel, a hinge arm mounted to the hood panel and hinged to the hinge bracket by a hinge shaft and including a rail slot formed at one end thereof, a support link unit pivotally linking the hinge bracket to the hinge arm, and a return link unit pivotally linking the support link unit and the rail slot of the hinge arm so that the support link unit is selectively locked by the return link unit.

11 Claims, 6 Drawing Sheets

HINGE APPARATUS OF ENGINE HOOD FOR VEHICLE

CROSS-REFERENCE TO RELATED APPLICATION

The present application claims priority to Korean Application No. 10-2008-0107204, filed on Oct. 30, 2008, the entire contents of which is incorporated herein for all purposes by this reference.

BACKGROUND OF THE INVENTION

1. Field of the Invention

The present invention relates to a hinge apparatus of an engine hood for a vehicle which opens or closes the engine hood using a double link structure.

2. Description of Related Art

Generally, engine hoods are provided in vehicles to accessibly enclose engine compartments. A hood lock is provided at a predetermined position in such an engine hood to releasably fasten the engine hood to a vehicle body. The hood lock has a spring therein and is connected to a release lever, which is installed in the passenger compartment.

As shown in FIG. 6, a conventional hinge apparatus for an engine hood includes a hinge bracket 4 which is fixed to a vehicle body panel 1, a hinge arm 3 which is rotatably connected to the hinge bracket 4, a hood stay rod 5 which supports the engine hood 2, and a fastening pin 6 which holds the hood stay rod 5.

When a worker (or user) rotates the engine hood 2 upwards after having unlocked a hood lock, the hinge arm 3 is rotated while the engine hood 2 is opened. The worker holds and supports the engine hood 2 using his/her one hand and places the hood stay rod 5 upright using the other hand such that the engine hood 2 is supported by the hood stay rod 5. Then, the engine hood 2 can be maintained in the open state.

However, in the conventional technique, a separate hood stay component, such as the hood stay rod 5, is required. Therefore, space for installation and actuation of the hood stay rod 5 is also required. In addition, when the engine compartment is repaired, the hood stay rod may act as a factor impeding the repair work of the worker. Furthermore, in addition to the hood stay rod, additional components, such as the fastening clip, a holder, etc., increase work effort and the production cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a hinge apparatus of an engine hood for a vehicle which simplifies the operation of opening or closing the engine hood.

In an aspect of the present invention, the hinge apparatus of an engine hood for a vehicle, provided between a hood panel and a stationary member to ensure rotation of the hood panel may include a hinge bracket mounted to the stationary member, a hinge arm mounted to the hood panel and hinged to the hinge bracket by a hinge shaft and including a rail slot formed at one end thereof, a support link unit pivotally linking the hinge bracket to the hinge arm, and/or a return link unit pivotally linking the support link unit and the rail slot of the hinge arm so that the support link unit is selectively locked by the return link unit.

A middle portion of the support link unit may be configured to be collapsible by operation of the return link unit.

In another aspect of the present invention, the hinge apparatus may further include an elastic member provided in the hinge bracket to elastically support one end of the support link unit such that the hood panel maintains an open state by locking the support link unit.

The support link unit may include a first support link hinged at a first end thereof to the hinge arm, and/or a second support link pivotally connecting a second end of the first support link to the hinge bracket, wherein the second support link is elastically supported by an elastic member provided in the hinge bracket such that the hood panel maintains an open state by locking the second support link and, wherein the return link unit may include a first return link hinged to the second support link and including a movable slot formed along a longitudinal direction at a first end thereof, and/or a second return link slidably connected at a first end thereof to the movable slot of the first return link and connected at a second end thereof to the rail slot of the hinge arm, wherein the second return link is pivotally coupled to a portion of the hinge bracket and the first and second end of the second return link are pivotal around the portion.

An opened angle control slot may be formed through the hinge bracket and the second end of the second return link may be coupled to the rail slot of the hinge arm through the opened angle control slot controlling an angle at which the hood panel is opened.

An allowable slot may be formed through the second end of the first support link, and a corresponding end of the second support link is movably connected to the allowable slot.

The rail slot may have an arc shape formed around the hinge shaft of the hinge arm.

An opened angle control slot may be formed through the hinge bracket and one end of the return link unit is coupled to the rail slot of the hinge arm through the opened angle control slot controlling an angle at which the hood panel is opened.

A stopper may be formed to the hinge bracket to limit the rotation of the second support link.

The stationary member may be a vehicle body panel.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
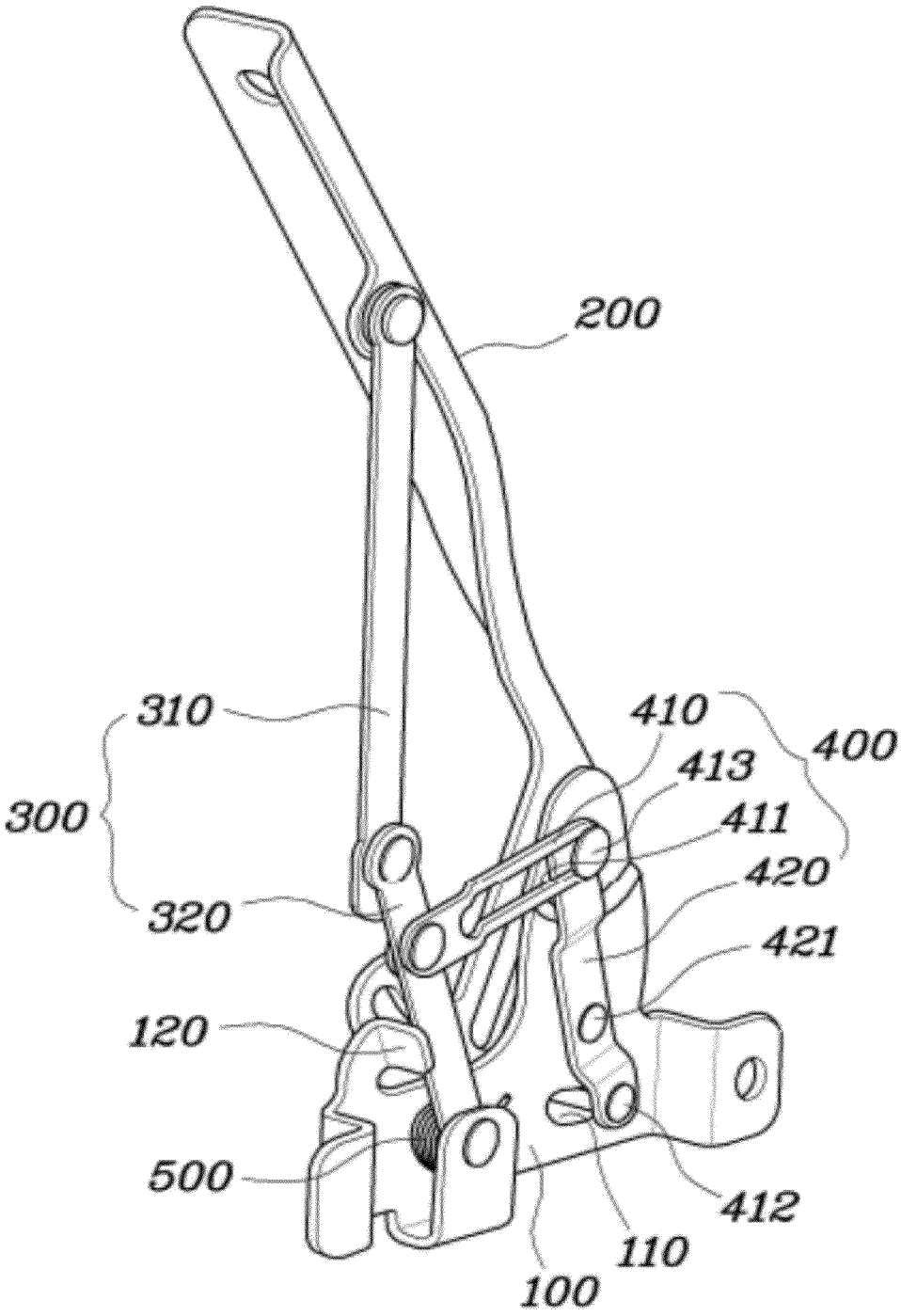
FIG. 1 is a perspective view, when seen from a first side, of an exemplary hinge apparatus of an engine hood for a vehicle, according to the present invention.
Figure 2:
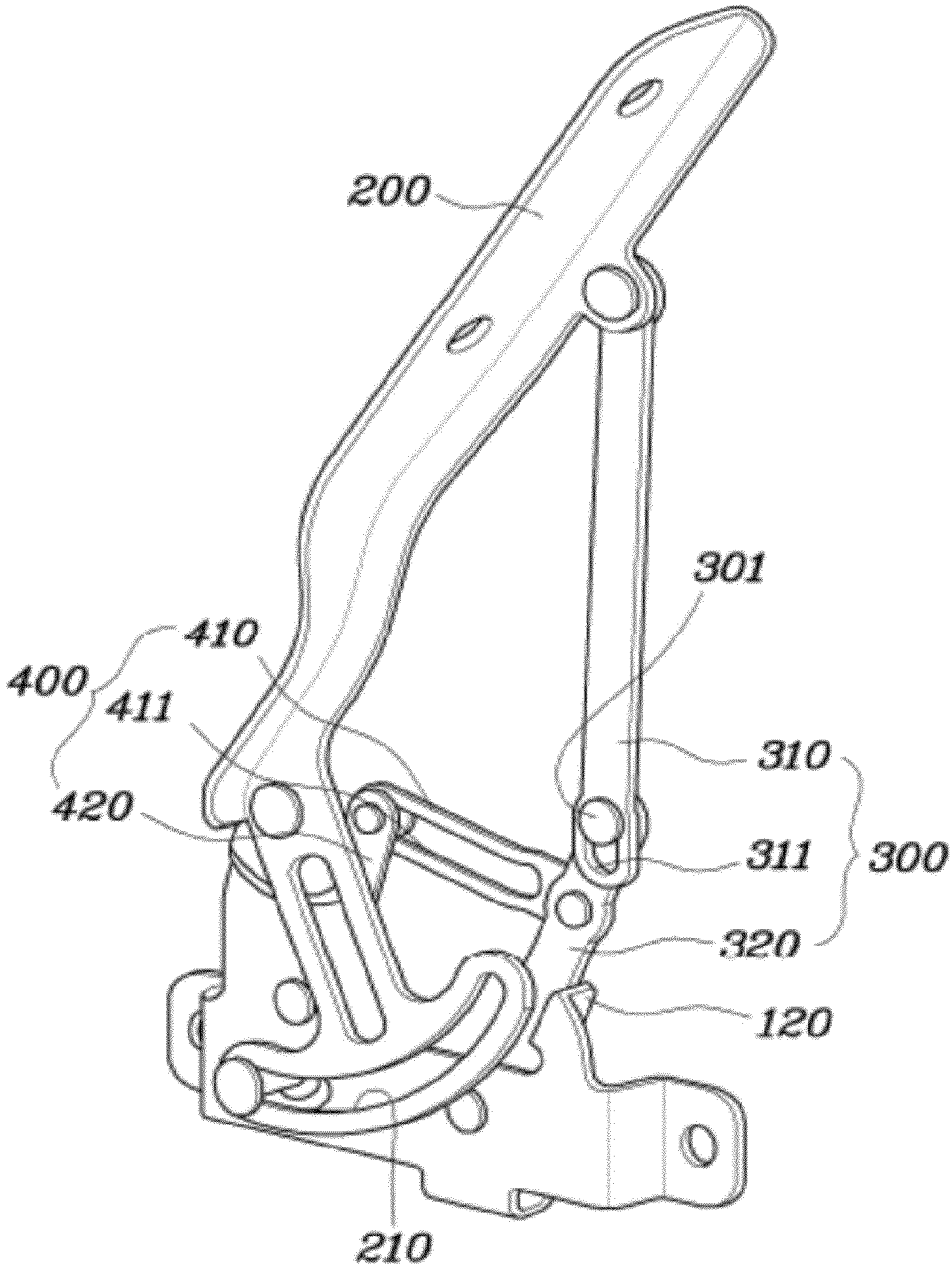
FIG. 2 is a perspective view of the exemplary hinge apparatus of FIG. 1 when seen from a second side.

As shown in FIGS. 1 or 2, a hinge apparatus of an engine hood for a vehicle according to various embodiments of the present invention can effectively realize the operation of opening or closing a hood panel using a link connection structure between a support link unit 300 and a return link unit 400 despite having no separate hood stay rod.

The hinge apparatus of various embodiments of the present invention includes a hinge bracket 100, a hinge arm 200, the support link unit 300 and the return link unit 400. The hinge arm 200 has a rail slot 210 and is hinged to the hinge bracket 100. The support link unit 300 links the hinge bracket 100 to the hinge arm 200. The return link unit 400 is hinged to the support link unit 300 and is movably coupled to the rail slot 210 of the hinge arm 200.

In detail, the hinge bracket 100 is fastened to a panel of a vehicle body. The hood panel is rotatably coupled to the hinge bracket 100 by the hinge arm 200. The hinge bracket 100 is linked to the support link unit 300 and the return link unit 400 to realize the operation of opening or closing the hood panel in multiple stages.

Furthermore, an elastic spring 500 is provided in the hinge bracket 100 to elastically support the support link unit 300. The elastic spring 500 is fastened at a first end thereof to the hinge bracket 100 and fastened at a second end thereof to the support link unit 300. The elastic spring 500 maintains a compressed state under normal conditions. Therefore, when the hood panel is opened, the support link unit 300 having a double link structure can be transformed into a shape that is bent towards the outside of the hinge apparatus by the expansive force of the elastic spring 500. Thus, the hood panel can stably maintain the open state.

In addition, an opened angle control slot 110 is formed through the hinge bracket 100, and a connection pin 412 of the return link unit 400 passes through the opened angle control slot 110. The opened angle control slot 100 defines the moving path of the connection pin 412 and thus controls the angle at which the hood panel is opened. The connection pin 412 which passes through the angle slot 110 connects the return link unit 400 to the rail slot 210 of the hinge arm 200.

The hinge arm 200 is mounted to the hood panel and is connected to the hinge bracket 100 using a hinge shaft. The rail slot 210 which has an arc shape formed around the hinge shaft is formed through the hinge arm 200. The connection pin 412 which passes through the opened angle control slot 110 is disposed in the rail slot 210. Therefore, the rail slot 210 prevents the hood panel from rotating in excess of the greatest over-opened angle to which the hood may be possibly opened. Furthermore, the rail slot 210 prevents the hood panel from rotating past the angle at which the hood is closed.

The support link unit 300 is connected to the hinge arm 200 and has the double link structure which connects the hinge arm 200 to the hinge bracket 100. The support link unit 300 includes a first support link 310 and a second support link 320.

Figure 4:
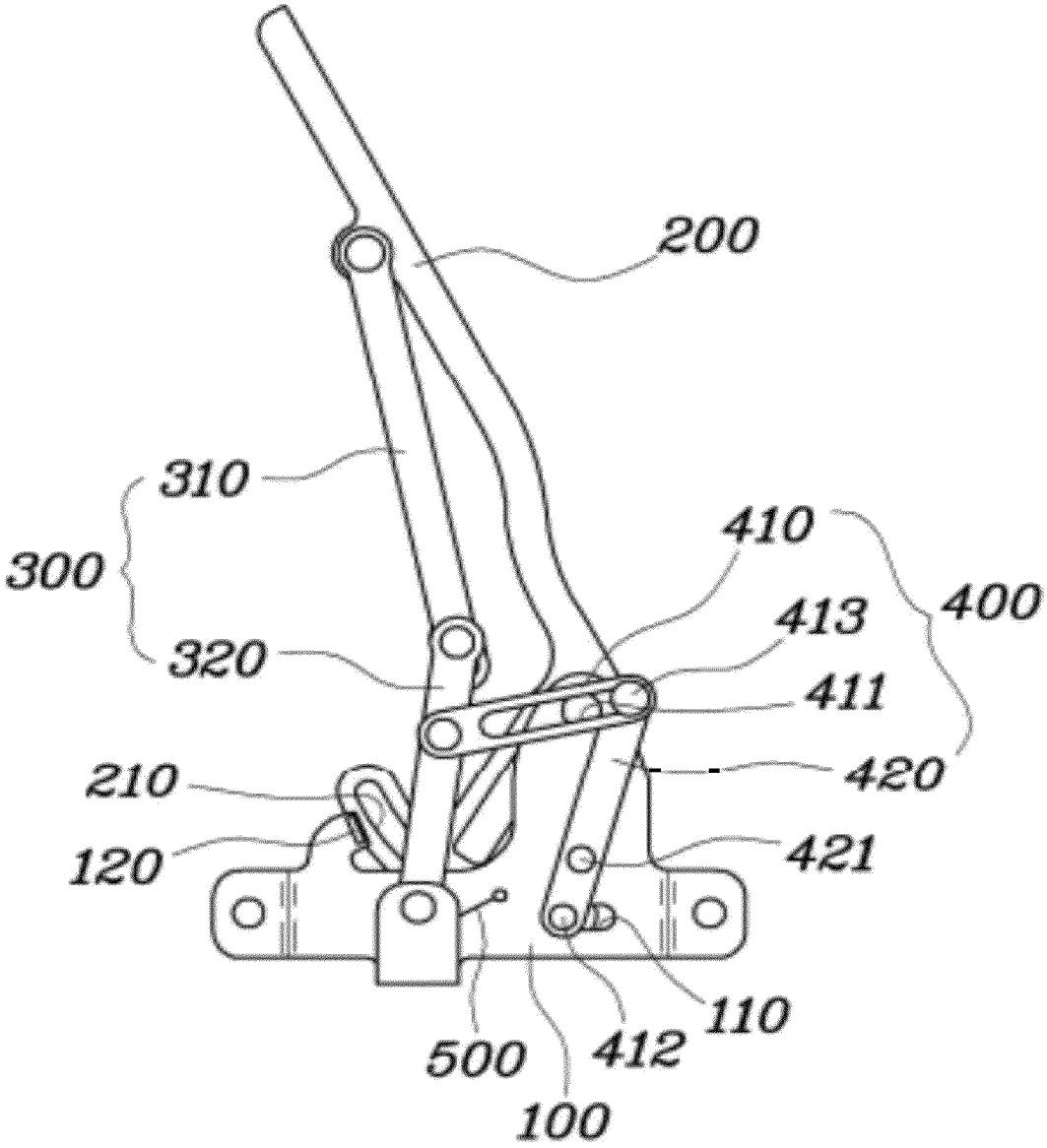
FIG. 4 is a view showing an over open state of the exemplary hinge apparatus which has been in the state of FIG. 3.

In detail, the first support link 310 is hinged at a first end thereof to the hinge arm 200 and is connected at a second end thereof to the second support link 320. The second support link 320 is connected at a first end thereof to the first support link 310 and is hinged at a second end thereof to the hinge bracket 100. An allowable slot 311 is formed through the second end of the first support link 310. The allowable slot 311 functions to make the operational relationship between the first support link 310 and the second support link 320 smooth when the hinge arm 200 rotates to the over-open state of the hood panel, as shown in FIG. 4. For this, a guide pin 301 which connects the second end of the first support link 310 to the first end of the second support link 320 is movably disposed in the allowable slot 311.

In various embodiments of the present invention, a stopper 120 may be formed on the hinge bracket 100 so that the rotation of the second support link 320 can be secured within a limited range.

The return link unit 400 is hinged to the second support link 320 and has a double link structure which links the second support link 320 to the hinge bracket 100. The return link unit 400 includes a first return link 410 and a second return link 420. The first return link 410 is hinged at a first end thereof to the second return link 320. The second return link 420 is connected at a first end thereof to the second end of the first return link 410 and connected at a second end thereof to the rail slot 210 of the hinge arm 200 by the connection pin 412.

Particularly, a movable slot 411 which extends in the longitudinal direction is formed through the second end of the first return link 410. The first end of the second return link 420 is connected to the movable slot 411 by a movable pin 413. In addition, the second return link 420 is hinged to the hinge bracket 100 by a stationary pin 421 such that the second return link 420 is actuated in a seesaw manner.

The operation of various embodiments of the present invention having the above-mentioned construction will be explained below.

Figure 3:
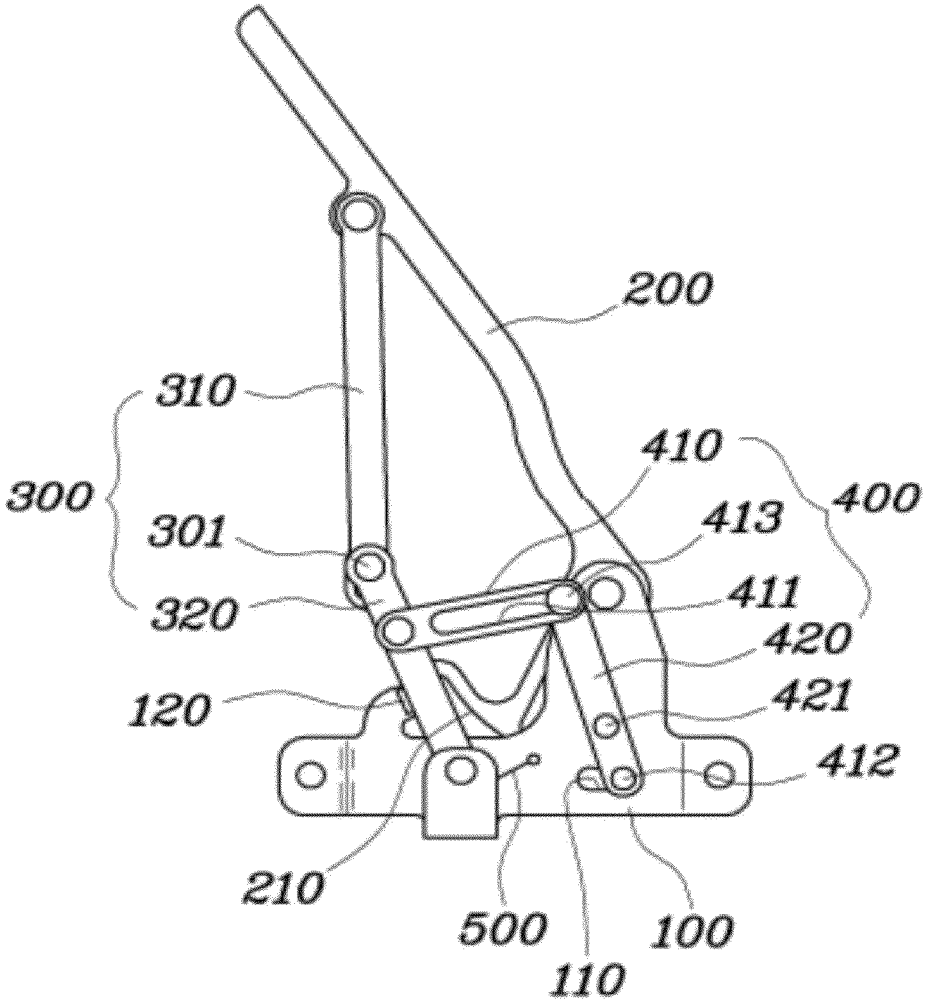
FIG. 3 is a side view showing an open state of the exemplary hinge apparatus when seen from the first side according to the present invention.

As shown in FIG. 3, when the hood panel is opened, the elastic spring 500 which has been compressed is released and thus expanded and the support link unit 300 is bent towards the outside of the hinge apparatus. Therefore, thanks to the elastic force of the elastic spring 500, a user can easily lifts the hood panel by using just a relatively small force.

At this time, the guide pin 301 is disposed at the upper end of the allowable slot 311. The connection pin 412 of the return link unit 400 is supported in the right end of the opened angle control slot 110. Thus, the hood panel is maintained in the open state.

Meanwhile, when it is desired to close the hood panel, as shown in FIG. 4, the user further lifts the hood panel at a predetermined angle such that the hood panel enters the over-open state. Then, the rail slot 210 pulls the connection pin 412. Thereby, the connection pin 412 moves to the left and reaches the left end of the opened angle control slot 110. At this time, the first return link 410 is moved to the right of FIG. 4 by the connection pin 412 which rotates to the left with respect to the stationary pin 421. Hence, the support link unit 300 collapses towards the inside of the hinge apparatus.

Figure 5:
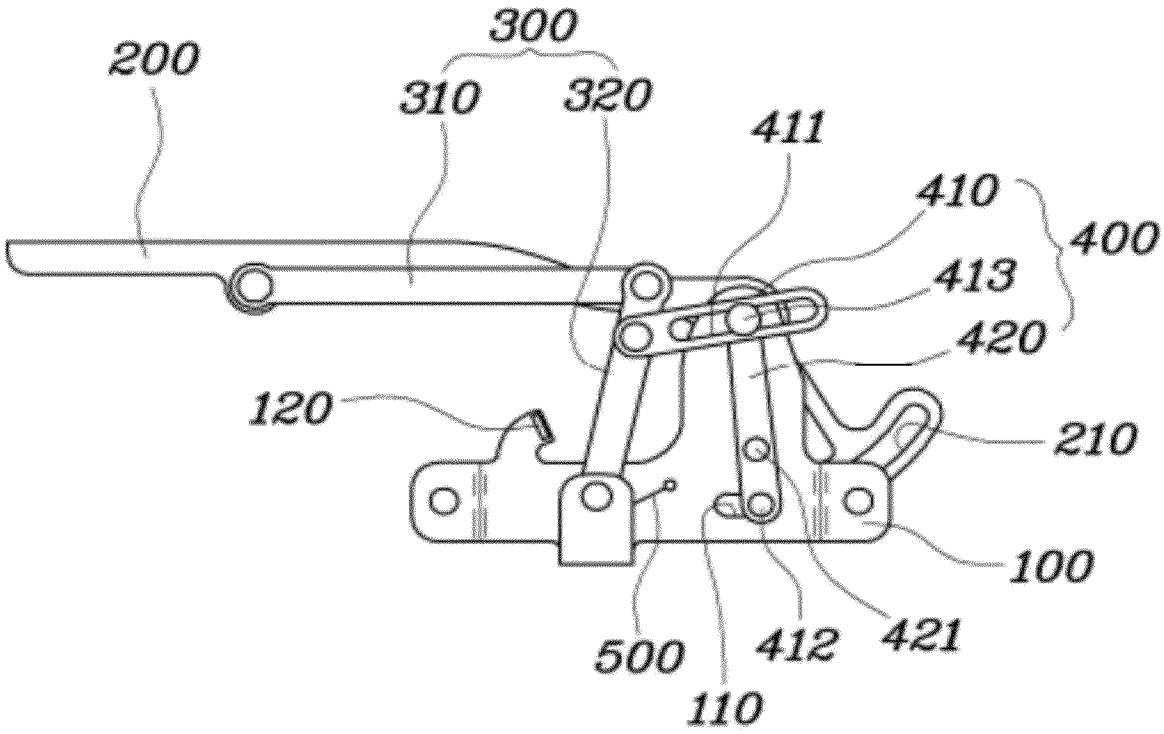
FIG. 5 is a view showing a closed state of the exemplary hinge apparatus which has been in the over open state of FIG. 4.
Figure 6:
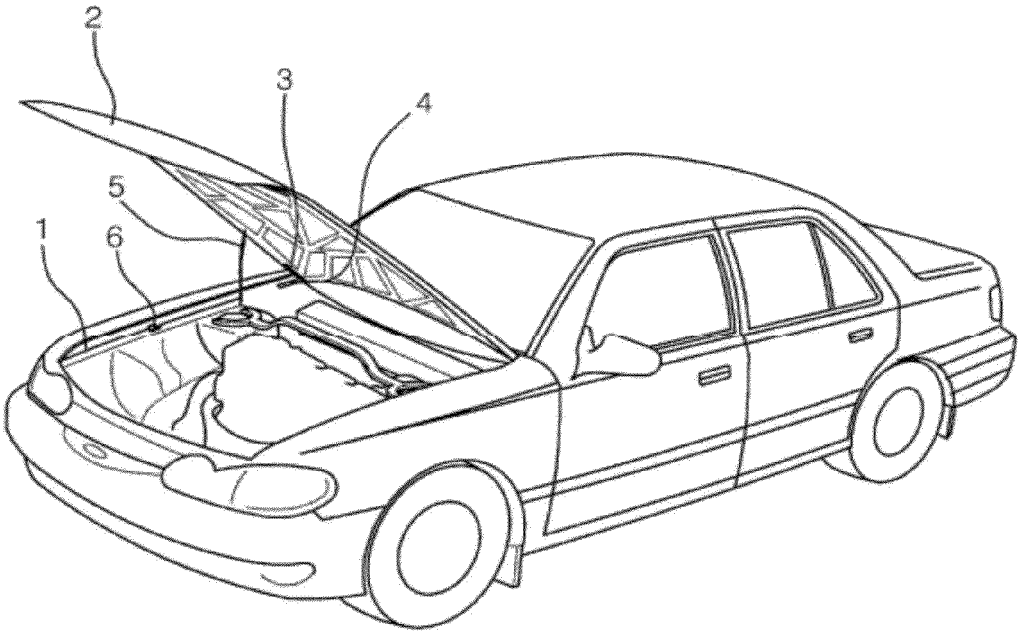
FIG. 6 (Prior Art)
FIG. 6 is a view showing the construction of a hinge apparatus of an engine hood for a vehicle according to a conventional technique.

Thereafter, when the hood panel is closed, the rail slot 210 pulls the connection pin 412 to the right of FIG. 5 by the rotation of the hinge arm 200. The connection pin 412 which has been moved to the right is supported on the right end of the opened angle control slot 110, thus maintaining the hood panel in the closed state, as shown in FIG. 5.

As described above, a hinge apparatus of an engine hood for a vehicle according to various aspects of the present invention does not require a separate hood stay rod or the like. Therefore, the number of components is reduced, thus reducing the production cost, and reducing the work effort required of a manufacturing line of a factory.

Furthermore, in various aspects of the present invention, because a space for installation of the hood stay rod is not required, the efficiency of repair work being done by a worker can be enhanced when engine compartment repair is being done.

For convenience in explanation and accurate definition in the appended claims, the term "inner" is used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A hinge apparatus of an engine hood for a vehicle, the hinge apparatus being provided between a hood panel and a stationary member to ensure rotation of the hood panel and comprising:

a hinge bracket mounted to the stationary member;

a hinge arm mounted to the hood panel and hinged to the hinge bracket by a hinge shaft and including a rail slot formed at one end thereof;

a support link unit pivotally linking the hinge bracket to the hinge arm; and a return link unit pivotally linking the support link unit and the rail slot of the hinge arm so that the support link unit is selectively locked by the return link unit, wherein the support link unit comprises:

a first support link hinged at a first end thereof to the hinge arm; and a second support link pivotally connecting a second end of the first support link to the hinge bracket; and wherein the return link unit comprises:

a first return link hinged to the second support link and including a movable slot formed along a longitudinal direction at a first end thereof; and a second return link slidably connected at a first end thereof to the movable slot of the first return link and connected at a second end thereof to the rail slot of the hinge arm, wherein the second return link is pivotally coupled to a portion of the hinge bracket and the first and second end of the second return link are pivotal around the portion.

2. The hinge apparatus as set forth in claim 1, wherein a middle portion of the support link unit is configured to be collapsible by operation of the return link unit.

3. The hinge apparatus as set forth in claim 1, further comprising:

an elastic member provided in the hinge bracket to elastically support one end of the support link unit such that the hood panel maintains an open state by locking the support link unit.

4. The hinge apparatus as set forth in claim 1, wherein the second support link is elastically supported by an elastic member provided in the hinge bracket such that the hood panel maintains an open state by locking the second support link.

5. The hinge apparatus as set forth in claim 1, wherein an opened angle control slot is formed through the hinge bracket and the second end of the second return link is coupled to the rail slot of the hinge arm through the opened angle control slot so as to control an angle at which the hood panel is opened.

6. The hinge apparatus as set forth in claim 1, wherein an allowable slot is formed through the second end of the first support link and a corresponding end of the second support link is movably connected to the allowable slot.

7. The hinge apparatus as set forth in claim 1, wherein the rail slot has an arc shape formed around the hinge shaft of the hinge arm.

8. The hinge apparatus as set forth in claim 1, wherein an opened angle control slot is formed through the hinge bracket and one end of the return link unit is coupled to the rail slot of the hinge arm through the opened angle control slot so as to control an angle at which the hood panel is opened.

9. The hinge apparatus as set forth in claim 1, wherein a stopper is formed to the hinge bracket to limit the rotation of the second support link.

10. The hinge apparatus as set forth in claim 1, wherein the stationary member is a vehicle body panel.

11. A passenger vehicle comprising the hinge apparatus as set forth in claim 1.

* * * * *